United States Patent [19]

Yoneyama et al.

[11] 4,275,146

[45] Jun. 23, 1981

[54] PHOTOGRAPHIC PHOTOSENSITIVE MATERIALS

[75] Inventors: Masakazu Yoneyama; Shoichi Ino; Junji Minamizono, all of Minami-ashigara, Japan

[73] Assignee: Fuji Photo Film Co., Ltd., Minami-ashigara, Japan

[21] Appl. No.: 102,284

[22] Filed: Dec. 10, 1979

[30] Foreign Application Priority Data

Dec. 13, 1978 [JP] Japan ..... 53-155266

[51] Int. Cl.[3] ..... G03C 1/76

[52] U.S. Cl. ..... 430/523; 430/531; 430/950; 430/961

[58] Field of Search ..... 430/523, 510, 514, 950, 430/954, 961, 531

[56] References Cited

U.S. PATENT DOCUMENTS

| | | | |
|---|---|---|---|
| 2,732,305 | 1/1956 | Richman et al. | 430/514 |
| 3,206,311 | 9/1965 | Campbell et al. | 430/496 |
| 3,433,638 | 3/1969 | Ohi et al. | 430/954 |
| 3,617,286 | 11/1971 | Kameyama et al. | 430/514 |

*Primary Examiner*—J. Travis Brown

*Attorney, Agent, or Firm*—Sughrue, Rothwell, Mion, Zinn and Macpeak

[57] ABSTRACT

A photographic photosensitive material which is characterized by at least one surface layer of the photographic photosensitive material containing an organic carboxylic acid amide of the following formula (I) having one or more unsaturated bonds:

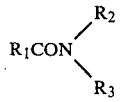

(I)

wherein $R_1$ represents a hydrocarbon group having 18 to 23 carbon atoms and at least one double bond and each of $R_2$ and $R_3$ represents a hydrogen atom or a lower alkyl group having 1 to 4 carbon atoms is disclosed.

13 Claims, No Drawings

PHOTOGRAPHIC PHOTOSENSITIVE MATERIALS

BACKGROUND OF THE INVENTION

1. Field of the Invention

This invention relates to a photographic photosensitive materials. More particularly, the present invention relates to photographic materials having improved in-camera running properties.

2. Description of the Prior Art

Photographic photosensitive materials often undergo undesirable abrasion through contact with various materials or through the contact with each other as occurs between the top face and the back face during e.g., take up, rewinding, transfer, etc., encountered during manufacture, e.g., coating, drying, processing, etc., and during use, e.g., shooting, developing, printing, projecting, etc. Examples of such undesirable influences are the formation of cracks and scratches, the aggravation of the driving performance of the photosensitive material in a camera or a projector, the generation of film scrap, etc.

There have heretofore been proposed various methods to provide photographic photosensitive materials having improved physical properties which can move smoothly and without any damage through gates such as those of a film magazine, a camera, a projector, etc., either by enhancing the anti-scuff strength of a photographic layer of the photographic material or by reducing the sliding friction on the surface of the photographic material. For example, a method for increasing anti-scuff strength by adding a certain type of gelatin hardener to a photographic component layer as described in British Pat. No. 1,270,578; a method for imparting sliding properties to photographic films by incorporating both dimethyl silicone and a specific surfactant in the emulsion layer or the protective layer as described in U.S. Pat. No. 3,042,522; methods for imparting sliding properties by coating, e.g., a mixture of dimethyl silicone and diphenyl silicone on the back face of a photographic film base as described in U.S. Pat. No. 3,080,317 and with a fatty acid ester of a polyol is described in British Pat. No. 1,466,304; a method for imparting sliding properties to photographic films by incorporating methyl phenyl silicone having triphenyl terminated blocks into the protective layer as described in British Pat. No. 1,143,118 and the like.

In addition, U.S. Pat. No. 2,732,305 and Japanese Patent Publication No. 13499/68 teach a method for preventing the transfer of an antihalation layer to the emulsion layer by adding an organic carboxylic acid amide to the antihalation layer provided on the back surface of the base and made of an alkali-soluble resin. However, attempts to improve the in-camera running properties of films using such methods, for example, with respect to a base back layer, although sliding properties (coefficient of friction, etc.) have undoubtedly been improved, there has been no improvement in running properties when passed through a camera under conditions of actual use or, if any improvement it has been accompanied by unwanted occurrences, e.g., the back surface becomes opaque and white after photographic processing (so-called haze), the coating properties in the manufacture of photographic photosensitive materials are adversely affected, the bonding power of film binders is reduced and so forth.

SUMMARY OF THE INVENTION

A principal object of the present invention is to provide photographic photosensitive materials which have improved in-camera running properties without impairing photographic properties, transparency (i.e., no haze), coating properties, bonding power, etc.

The above object has bee accomplished by incorporating in at least one surface layer of the photographic photosensitive material an organic carboxylic acid amide of the following formula (I) having one or more unsaturated substituents:

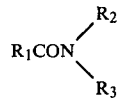

(I)

wherein $R_1$ represents an unsaturated hydrocarbon group having 18 to 23 carbon atoms, preferably 21 to 23 carbon atoms and at least one double bond and each of $R_2$ and $R_3$ represents a hydrogen atom or a lower alkyl group having 1 to 4 carbon atoms, preferably a hydrogen atom, a methyl group or an ethyl group.

DETAILED DESCRIPTION OF THE INVENTION

The hydrocarbon group for $R_1$ may be either straight-chained or branched chained, preferably straight-chained and preferably contains one carbon-to-carbon double bond.

Examples of $R_1$ are $C_{21}H_{41}$, $C_{23}H_{41}$, etc. Examples of $R_2$ and $R_3$ are $CH_3$, $C_2H_5$, $C_3H_7$, $C_4H_9$, etc. Representative examples of the amides used in the present invention are as follows:

Compound (1) erucic amide
Compound (2) erucic acid-N-methylamide
Compound (3) erucic acid-N-ethylamide
Compound (4) selacholeic acid-N-methylamide
Compound (5) selacholeic acid-N,N-diethylamide The aforementioned compounds can be easily produced by known methods. For example, erucic amide is obtained by reacting erucic anhydride or erucic chloride with dry ammonia in absolute diethyl ether. Some of these compounds are also commercially available. For example, Armoslip-E (Lion-Armour Corp.) contains the above compound (1) as the main ingredient.

The superiority of the compounds used in the present invention to saturated fatty acid amides and other solvents for the purposes of the present invention is probably because the amides used in the present invention have relatively low melting points, are very soluble in organic solvents and have good affinity to the base.

In general, when compounds which have a poor affinities for the base and higher melting points are used as lubricants, haze formation on photographic processing prevails. On the other hand, where the lubricant is a liquid and used alone, the resulting running properties of the film are often unsatisfactory (for example, silicone oil is not suitable).

The compounds in accordance with the present invention are added to a surface layer of a photographic photosensitive material. The surface layer may be a protective layer (i.e., on the photosensitive side of the material) and/or a back layer. The back layer may contain hydrophilic colloids such as gelatin, etc., as a binder or contain a hydrophobic binder such as cellulose diacetate, etc. Alternatively, a separate layer containing the compound in accordance with the present invention may be provided on the protective layer and/or the back layer.

The photographic material of the present invention may be prepared by adding the amide to a photographic surface coating solution such as a hydrophilic colloidal dispersion for forming the protective layer, etc., or any of various coating solutions for forming the back layer, or the protective layer may be overcoated or impregnated with a solution of the compound in an appropriate solvent. More particularly, in the case of a coating of a hydrophilic colloidal dispersion, the compound can be added to the hydrophilic colloid as an aqueous dispersion which has been prepared using an appropriate dispersant or it can be added directly to the colloid in the presence of an appropriate dispersant or as diluted with an organic solvent which can dissolve the compounds in accordance with the present invention. For the organic solvent based coating solutions with hydrophobic binder for the back layer, the compound can easily be added after being dissolved in an organic solvent.

The coating compositions containing the compounds in accordance with the present invention can be used to coat or impregnate the desired layer by, for example, a dip method as described in U.S. Pat. No. 3,335,026, a spray method as described in U.S. Pat. No. 2,674,167, etc. In order to obtain the maximum effect of the compounds in accordance with the present invention, it is especially desired to apply them to the outermost layer on the back side of the material.

Although the amounts of the compounds used in the present invention are not limited, it is preferred to employ about 0.02 to 10% by weight, more preferably about 0.1 to 7% by weight of the compounds, based on the solids of the coating composition when used by adding to a coating composition for the surface protective layer or for the back layer containing a binder of hydrophilic colloids. For a back layer containing no hydrophilic colloids (e.g., containing a hydrophobic binder) or for the overcoat layer, it is preferred to apply the compounds at a coverage of about 5 to 500 mg/m$^2$, especially 20 to 100 mg/m$^2$.

When the organic compounds in accordance with the present invention are applied to the back surface of the base, examples of jointly used binders having film forming properties are cellulose esters such as cellulose triacetate, cellulose diacetate, cellulose acetate maleate, cellulose acetate phthalate, hydroxyalkyl alkyl cellulose phthalate (wherein the alkyl group contains 1 to 4 carbon atoms), hydroxyalkyl alkyl cellulose tetrahydrophthalate (wherein the alkyl group contains 1 to 4 carbon atoms), hydroxyalkyl alkyl cellulose hexahydrophthalate (wherein the alkyl group contains 1 to 4 carbon atoms), etc.; polycondensate polymers such as polycondensates of formaldehyde with cresol, salicylic acid and hydroxyphenylacetic acid, polycondensates of terephthalic acid and phthalic acid with polyalkylene glycols (ethylene glycol, propylene glycol, their dimer, trimer, tetramer, etc.), etc.; synthetic polymers obtained from monomers having polymerizable unsaturated bonds such as homopolymers of acrylic acid, methacrylic acid, styrenecarboxylic acid, styrenesulfonic acid, etc., the copolymers of such acids and maleic anhydride with styrene derivatives, alkyl acrylates (wherein the alkyl group contains 1 to 4 carbon atoms), alkyl methacrylates (wherein the alkyl group contains 1 to 4 carbon atoms), vinyl chloride, vinyl acetate, alkyl vinyl ethers (wherein the alkyl group contains 1 to 4 carbon atoms), acrylonitrile, etc., their open ring half esters, half amides, etc., partially hydrolyzed polyvinyl acetate, polyvinylalcohol, etc.

When a binder is employed, water, an organic solvent or their mixture can be employed as a solvent. Examples of the aforementioned organic solvents and those mentioned here include alcohols such as methanol, ethanol, butanol, etc., ketones such as acetone, methyl ethyl ketone, etc., halogenated hydrocarbons such as methylene chloride, carbon tetrachloride, chloroform, etc., ethers such as diethyl ether, dioxane, tetrahydrofuran, etc., aromatic hydrocarbons such as benzene, toluene, xylene, etc., alicyclic hydrocarbons such as cyclopentane, cyclohexane, etc., aliphatic hydrocarbons such as n-hexane, n-octane, etc., and so forth.

In the photographic photosensitive materials in accordance with the present invention, any of the conventional supports commonly employed for the photographic photosensitive materials can be employed. Such examples are cellulose acetate film, cellulose acetate butyrate film, polystyrene film, polyethylene terephthalate film, their laminates, paper, etc. Also included are baryta paper and paper coated or laminated with an $\alpha$-olefin polymer, e.g., the monomer of which contains 2 to 10 carbon atoms, especially polyethylene, polypropylene, etc.

Various kinds of hydrophilic colloids are employed in the photographic photosensitive materials in accordance with the present invention and examples of the hydrophilic colloids used as a binder for the photographic emulsion layer and/or other photographic component layers include gelatin, colloidal albumin, casein, cellulose derivatives such as carboxymethyl cellulose, hydroxyethyl cellulose, etc., agar, sodium alginate, saccharide derivatives such as starch derivatives, synthetic hydrophilic colloids such as polyvinylalcohol, poly-N-vinylpyrrolidone, polyacrylic acid copolymers, polyacrylamide, their derivatives, their partial hydrolysates, etc. If necessary, a compatible mixture of two or more from the above colloids may be used. Most commonly used among the above is gelatin.

In the photographic emulsion layer or other layers used in the present invention, synthetic polymers, for example, water dispersed vinyl compound polymers, especially those which increase the dimensional stability of the photographic materials are employed either alone or in combination with each other or with water-permeable colloids. There are many polymers for such purposes and examples are disclosed in, for example, U.S. Pat. Nos. 2,376,005, 2,739,137, 2,853,457, 3,062,674, 3,411,911, 3,488,708, 3,525,620, 3,635,715, 3,607,290, 3,645,740, British Pat. Nos. 1,186,699, 1,307,373, etc. Among the above publications, copolymers and homopolymers selected from alkyl acrylates, alkyl methacrylates, acrylic acid, methacrylic acid, sulfoalkyl acrylate, sulfoalkyl methacrylate, glycidyl acrylate, glycidyl methacrylate, hydroxyalkyl acrylates, hydroxyalkyl methacrylates, alkoxyalkyl acrylates, alkoxyalkyl methacrylates, styrene, butadiene, vinyl chloride, vinylidene chloride, maleic anhydride and itaconic anhydride are commonly employed.

The hardening process of the photographic emulsion and/or other photographic layers can be conducted according to well known methods. Examples of the hardener are aldehyde compounds such as formaldehyde, glutaraldehyde, etc., ketone compounds such as diacetyl, cyclopentanedione, etc., compounds having reactive halogens such as bis(2-chloroethyl urea), 2-hydroxy-4,6-dichloro-1,3,5-triazine and those disclosed in U.S. Pat. Nos. 3,288,775, 2,732,303, British Pat. Nos. 974,723, 1,167,207, etc., compounds having reactive olefins such as divinylsulfone, 5-acetyl-1,3-diacryloyl-hexahydro-1,3,5-triazine and those disclosed in U.S. Pat. Nos. 3,635,718, 3,232,763, 3,490,911, 3,642,486, British Pat. No. 994,869, etc., N-methylol compounds such as N-hydroxymethylphthalimide and those disclosed in U.S. Pat. Nos. 2,732,316, 2,586,168, etc., isocyanate compounds disclosed in U.S. Pat. No. 3,103,437, etc., aziridine compounds disclosed in U.S. Pat. Nos. 3,017,280, 2,983,611, etc., acid derivatives disclosed in U.S. Pat. Nos. 2,725,294, 2,725,295, etc., carbodiimide compounds disclosed in U.S. Pat. No. 3,100,704, etc., epoxy compounds disclosed in U.S. Pat. No. 3,091,537, etc., isooxazole compounds disclosed in U.S. Pat. Nos. 3,321,313, 5,543,292, etc., halogenocarboxyaldehydes such as mucochloric acid, dioxane derivatives such as dihydroxydioxane, dichlorodioxane, etc., and inorganic hardeners such as chrome alum, zirconium sulfate, etc. Instead, it is also possible to use those in the precursor form, e.g., alkali metal bisulfite aldehyde addition product, methylol derivative of hydantoin, primary fatty acids, nitroalcohols, etc.

Silver halide photographic emulsions can usually be produced by mixing a water-soluble silver salt (e.g., a silver nitrate) solution and a water-soluble halide (e.g., a potassium bromide) solution in the presence of a water-soluble polymer solution such as a gelatin solution. As the silver halide, silver chloride, silver bromide and mixed silver halides such as silver bromochloride, bromoiodide, bromochloroiodide, etc. can be employed.

The above-mentioned photographic emulsions can incorporate various compounds in order to prevent a reduction in sensitivity, fogging, etc., during the manufacture, storage or processing of the photographic materials. As such additives, numerous compounds including 4-hydroxy-6-methyl-1,3,3a, 7-tetrazaindene, 3-methylbenzothiazole, 1-phenyl-5-mercaptotetrazole, many other heterocyclic compounds, mercury containing compounds, mercapto compounds, metal salts, etc., are used.

The silver halide emulsions can be chemically sensitized according to the methods well known in the art. Examples of the chemical sensitizer are gold compounds such as chloroaurates, gold (III) chloride, etc., salts of noble metals such as platinum, palladium, iridium, rhodium, ruthenium, etc., sulfur compounds which form silver sulfide upon reaction with silver salts, stannous salts, amines, other reducing materials, etc.

The photographic emulsions can, depending on the necessity, be spectrally sensitized or supersensitized using cyanine dyes such as cyanine, merocyanine, carbocyanine, etc., either alone or in combination with each other or with styryl dyes.

The photographic photosensitive materials can contain in the non-sensitize photographic layers, for example, stilbene, triazine, oxazole and coumarin compounds as brighteners, benzotriazole, thiazolidine, cinnamate ester compounds, etc., as ultraviolet absorbers, various known photographic filter dyes as light absorbers, etc. These materials can further contain, if necessary, other slipping agents or anti-stick agents such as fatty acid amides, esters and polyesters disclosed in U.S. Pat. Nos. 2,732,305, 4,042,399, 3,121,060, British Pat. No. 1,466,304, etc., water-insoluble materials disclosed in British Pat. Nos. 1,320,564, 1,320,565, U.S. Pat. No. 3,121,060, etc., and surfactants disclosed in U.S. Pat. No. 3,617,286, etc. There is a restriction on the amounts of the lubricants other than those of the present invention; they must be used in amounts of up to 1:1 (by weight) based on the lubricants in accordance with the invention. In addition, as matting agents, inorganic compounds such as silver halides, silica, strontium barium sulfate, etc., having suitable particle size, polymer latices such as polymethyl methacrylate, etc., can be present.

The photographic photosensitive materials in accordance with the present invention can further contain antistatic agents in the photographic component layers including the photographic emulsion layer, especially in the antistatic layer provided on the outermost side of the photographic material. Examples of the antistatic agents are hydrophilic polymers disclosed in U.S. Pat. Nos. 2,725,297, 2,972,535, 2,972,536, 2,972,537, 2,972,538, 3,033,679, 3,072,484, 3,262,807, 3,525,621, 3,615,531, 3,630,743, 3,653,906, 3,655,384, 3,655,386, British Pat. Nos. 1,222,154, 1,235,075, etc., hydrophobic polymers disclosed in U.S. Pat. Nos. 2,973,263, 2,976,148, etc., biguanide compounds disclosed in U.S. Pat. Nos. 2,584,362, 2,591,590, etc., sulfone type anion compounds disclosed in U.S. Pat. Nos. 2,639,234, 2,649,372, 3,201,251, 3,457,076, etc., phosphate esters and quaternary ammonium salts disclosed in U.S. Pat. Nos. 3,317,344, 3,514,291, etc., cationic compounds disclosed in U.S. Pat. Nos. 2,882,157, 2,982,651, 3,399,995, 3,549,369, 3,564,043, etc., nonionic compounds disclosed in U.S. Pat. No. 3,625,695, amphoteric compounds disclosed in U.S. Pat. No. 3,736,268, etc., complex compounds disclosed in U.S. Pat. No. 2,647,836, etc., and organic salts disclosed in U.S. Pat. Nos. 2,717,834, 3,655,387, etc.

The compounds in accordance with the present invention can be applied to any kind of photographic photosensitive material regardless of whether it is monochromatic or color.

The silver halide emulsions include orthochromatic emulsions, panchromatic emulsions, emulsions for infrared light, emulsions for X-ray recording and other invisible light, emulsions for color photography, such as emulsions containing color developing couplers, emulsions containing dye developers, emulsions containing bleachable dyes, etc.

The emulsions for color photography may contain two or four equivalent color forming couplers. For example, closed type ketomethylene yellow color forming couplers such as benzoyl acetanilide compounds, pivaloyl acetanilide compounds, etc., magenta color forming couplers such as pyrazolones, indazolones, etc., and cyan color forming couplers such as phenolic, naphtholic compounds, etc., are preferably employed. For example, it is possible to use yellow couplers defined by the generic formula (I) described in Japanese Pat. Publication No. 18256/73, magenta couplers disclosed in U.S. Pat. No. 3,706,556, cyan couplers disclosed in Japanese Patent Application No. 76515/71, colored couplers disclosed in U.S. Pat. Nos. 2,428,054, 2,449,966, 2,455,170, 2,600,788, 2,983,608, 3,148,062, etc., release inhibiting couplers disclosed in U.S. Pat. No. 3,227,554, etc.

The compounds used in the present invention can improve physical properties such as anti-scuff properties. slip properties, etc., of photographic photosensitive materials without harming the photographic properties (e.g., fogging, desensitization, etc.) of the photosensitive materials. The compounds used in the present invention can impart appropriate slip properties according to the requirements of photographic photosensitive materials to which they are applied, and especially they can improve compatibility of the motion picture film under the actual use with the camera. The motion picture films treated according to the present invention have good slip properties and anti-scuff properties, and hence can move very smoothly which also greatly reduces noise of the films in actual use. Furthermore, as is often the case with the conventional photographic materials when used in certain cameras, film scrap is produced due to the partial destruction of the materials by sharp edges or too heavy stress at the contact sites of the running film. The motion picture films treated according to the present invention can advantageously overcome such problems.

In the meantime, as a technique similar to the present invention, where the binder in the back layer is a hydrophobic polymer such as cellulose acetate it can also be contemplated to use, as the lubricants compounds analogous to the lubricants in accordance with the present invention, that is, the compounds of the formula (I) with the same definition as in the present invention except that $R_1$ is an alkyl group having 3 to 24 carbon atoms or an alkenyl group having 17 or less carbon atoms; all of these compounds are not as satisfactory as those in accordance with the present invention by comparison.

The present invention is described in more detail by the following examples. Unless otherwise indicated all parts are by weight.

EXAMPLE 1

Back layers were prepared by coating triacetyl cellulose photographic film supports with coating compositions having the following compositions and drying at 90° C. for three minutes.

TABLE 1

| | Coating Composition (parts) | | | | |
|---|---|---|---|---|---|
| | 1-1 | 1-2 | 1-3 | 1-4 | 1-5 |
| Diacetate cellulose | 4 | 4 | 4 | 4 | 4 |
| Acetone | 800 | 800 | 800 | 800 | 800 |
| Methanol | 200 | 200 | 200 | 200 | 200 |
| Compound (1) | — | 2 | — | — | — |
| Comparison Compound (A) | — | — | 2 | — | — |
| Comparison Compound (B) | — | — | — | 2 | — |
| Comparison Compound (C) | — | — | — | — | 2 |
| Obtained base | Base 1-1 | Base 1-2 | Base 1-3 | Base 1-4 | Base 1-5 |

Comparison Compound (A):

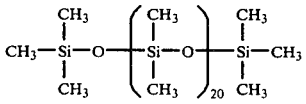

Comparison Compound (B):
$C_{21}H_{43}CONH_2$
Comparison Compound (C):
$C_{17}H_{33}CONH_2$ On the opposite side of each of the above five back base layers were applied an undercoat layer, after which a red-sensitive layer, a gelatin intermediate layer, a green-sensitive layer, a yellow filter layer, a blue-sensitive layer and a protective layer were successively applied to prepare corresponding color negative films for motion pictures (cine-films) 1-1, 1-2, 1-3, 1-4 and 1-5, respectively. They were tested for slip properties on the back surface in an atmosphere of 23° C. and 65% RH. In addition, the transparency of the films after development was visually evaluated in each case.

The layers were tested for (1) coefficient of sliding friction (against a steel ball) and (2) frictional force against a camera pressure plate simulating practical conditions. The latter test method shows good correlation with the in-camera running properties in actual use.

(1) Measurement of coefficent of sliding friction (on a sliding friction coefficient tester manufactured by Toyo Baldwin Co.)

A steel ball of 5 mm in diameter charged with a weight of 20 g is put into contact with the back surface of the films. The resistance obtained by sliding the film at 20 cm/min for a distance of 8 cm is detected on a strain gauge and automatically recorded on a chart.

(2) Frictional force against a camera pressure plate

A sample film is fixed on a flat table with its back upward. On the sample is mounted a pressure plate of a camera (a pressure plate of a Scopic camera manufactured by Canon Inc.) and a weight of 500 g is applied on the pressure plate. The camera pressure plate is slid on the back surface of the film (at a speed of 2 cm/sec) and the required tension is read on a tention meter.

The results obtained are shown in Table 2.

TABLE 2

| | Sliding Performance of the Back Layer | | |
|---|---|---|---|
| Film | Coefficient of Sliding Friction | Frictional Force (against camera pressure plate (g) | Transparency |
| 1-1 (Control) | 0.45 | 1,000–1,300 | Good |
| 1-2 (Invention) | 0.16 | 70–80 | Good |
| 1-3 (Comparison) | 0.19 | 110–120 | Slightly poor |
| 1-4 (Comparison) | 0.18 | 80–90 | Markedly poor |
| 1-5 (Comparison) | 0.40 | 1,000–1,200 | Good |

As apparent from Table 2, it can be seen that the addition of the compounds of the present invention greatly improved the in-camera running properties.

In addition, there were no adverse influences observed on photographic properties (e.g., sensitivity, fogging, graininess, sharpness, etc.), transparency of films, bonding power of films, etc., when the compounds of the present invention were used.

On the other hand, when Comparison Compound (A) was used, a so-called uneven coating resulted during the coating of the emulsion and photographic properties were adversely affected.

When Comparison Compound (B) was used, the transparency of the films was greatly impaired due to the separating of the compound on the base surface.

With Comparison Compound (C) the sliding performance of the back was not improved at all.

EXAMPLE 2

Back layers were prepared by coating triacetyl cellulose photographic film supports with coating compositions having the following compositions and drying at 90° C. for three minutes.

TABLE 3

| | Coating Composition (parts) | | |
|---|---|---|---|
| | 2-1 | 2-2 | 2-3 |
| Diacetyl cellulose | 4 | 4 | 4 |
| Acetone | 800 | 800 | 800 |

TABLE 3-continued

| | Coating Composition (parts) | | |
|---|---|---|---|
| | 2-1 | 2-2 | 2-3 |
| Methanol | 200 | 200 | 200 |
| Aerosil-200 (by Nippon Aerosil Co., particle size: ≦1μ) | 0.4 | 0.4 | 0.4 |
| Compound (1) | — | 2 | — |
| Comparison Compound (B) | — | — | 2 |
| Obtained Base | Base 2-1 | Base 2-2 | Base 2-3 |

Bases 2-1, 2-2 and 2-3 were coated with the same emulsion for color negative motion picture films as in Example 1 to obtain Films 2-1, 2-2 and 2-3, respectively. The same tests for sliding performance as in Example 1 were conducted and the results shown in Table 4 were obtained.

TABLE 4

| | Sliding Performance of the Back Layer | | |
|---|---|---|---|
| Film | Coefficient of Sliding Friction | Frictional Force (against camera) pressure plate) (g) | Transparency |
| 2-1 (Control) | 0.50 | 150-200 | Good |
| 2-2 (Invention) | 0.17 | 65-75 | Good |
| 2-3 (Comparison-(B)) | 0.19 | 80-90 | Markedly poor |

From the values given in Table 4, it can be seen that Film 2-2 of the present invention had significantly improved in-camera running properties and good coating performance.

EXAMPLE 3

Back layers were prepared by coating triacetyl cellulose photographic film supports with coating compositions having the following compositions and drying at 90° C. for three minutes.

TABLE 5

| | Coating Composition (parts) | | | |
|---|---|---|---|---|
| | 3-1 | 3-2 | 3-3 | 3-4 |
| Diacetyl cellulose | 10 | 10 | 10 | 10 |
| Acetone | 800 | 800 | 800 | 800 |
| Methanol | 200 | 200 | 200 | 200 |
| Aerosil-200 (by Nippon Aerosil Co.; particle size: ≦1μ) | 0.7 | 0.7 | 0.7 | 0.7 |
| Compound (1) | — | 2 | 1 | — |
| Comparison Compound (B) | — | — | 1 | 2 |
| Obtained base | Base 3-1 | Base 3-2 | Base 3-3 | Base 3-4 |

The above four bases (3-1, 3-2, 3-3 and 3-4) were coated with the same emulsion for color negative motion picture films as in Example 1 to obtain Films 3-1, 3-2, 3-3 and 3-4, respectively. The same tests for sliding performance as in Example 1 were conducted and the results shown in Table 6 were obtained.

TABLE 6

| | Sliding Performance of the Back Layer | | |
|---|---|---|---|
| Film | Coefficient of Sliding Friction | Frictional Force (against camera pressure plate) (g) | Transparency |
| 3 - 1 (Control) | 0.50 | 200-250 | Good |
| 3 - 2 (Invention) | 0.16 | 65-70 | Good |

TABLE 6-continued

| | Sliding Performance of the Back Layer | | |
|---|---|---|---|
| Film | Coefficient of Sliding Friction | Frictional Force (against camera pressure plate) (g) | Transparency |
| 3 - 3 (Invention) | 0.17 | 70-75 | Good |
| 3 - 4 (Comparison) | 0.19 | 80-90 | Markedly poor |

As shown in Table 6, Film 3-3 showed comparable in-camera running properties to those of Film 3-2.

On the other hand, in the case where the comparison compound was added (Film 3-4), it is evident that the coating performance (transparency) was significantly deteriorated, although there was considerable improvement in in-camera running properties.

EXAMPLE 4

Photographic cellulose triacetate film supports were coated with Antistatic Agents B, C and D respectively and dried at 70° C. for one minute to prepare Bases 4-1, 4-2 and 4-3, respectively, as shown in Table 7.

TABLE 7

| | Coating Composition (parts) | | |
|---|---|---|---|
| | 4-1 | 4-2 | 4-3 |
| Acetone | 200 | 200 | 200 |
| Methanol | 800 | 800 | 800 |
| Antistatic Agent B | 2 | — | — |
| Antistatic Agent C | — | 2 | — |
| Antistatic Agent D | — | — | 2 |
| Obtained Base | Base 4-1 | Base 4-2 | Base 4-3 |

Antistatic Agent B:

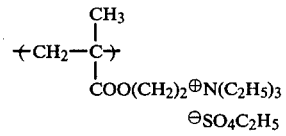

Antistatic Agent C:

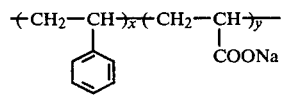

x:y = 1:2

Antistatic Agent D:

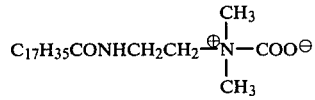

The above bases were coated with the Coating Composition for the Back 3-2 prepared in Example 3 and dried at 90° C. for three minutes to prepare Bases 5-1, 5-2 and 5-3, respectively. The Bases 5-1, 5-2 and 5-3 were coated with the same emulsion for color negative motion picture films as in Example 1 to obtain Films 5-1, 5-2 and 5-3, respectively. The same tests for sliding performance as in Example 1 were conducted and the results shown in Table 8 were obtained.

TABLE 8

| | Sliding Performance of the Back Layer | |
|---|---|---|
| Film | Coefficient of Sliding Friction | Frictional Force (against camera pressure plate) (g) |
| 5 - 1 | 0.16 | 65-75 |
| 5 - 2 | 0.15 | 60-70 |
| 5 - 3 | 0.16 | 60-75 |

As shown in Table 8, each film (5-1, 5-2 and 5-3) retained the in-camera running properties comparable to those of Film 3-2, thus indicating a remarkable improvement in properties.

EXAMPLE 5

Three antihalation layers were formed on triacetyl cellulose photographic film supports respectively by coating each support with each coating composition having the following compositions and drying at 90° C. for three minutes.

TABLE 9

| | Coating Composition (parts) | | |
|---|---|---|---|
| | 6-1 | 6-2 | 6-3 |
| Hydroxypropyl methyl cellulose hexahydrophthalate Hexahydrophthalyl group 38% Hydroxypropyoxy group 8% Methoxyl group 16% | 20 | 20 | 20 |
| Carbon black | 9.6 | 9.6 | 9.6 |
| Acetone | 600 | 600 | 600 |
| Methyl Cellosolve | 150 | 150 | 150 |
| Methanol | 200 | 200 | 200 |
| Compound (1) | — | 2.5 | — |
| Comparison Compound (B) | — | — | 2.5 |
| Obtained Base | Base 6-1 | Base 6-2 | Base 6-3 |

The above three bases were further applied with each photosensitive layer to obtain color negative films (Films 6-1, 6-2 and 6-3), respectively. These films were tested for sliding performance as in Example 1 and the results shown in Table 10 were obtained.

TABLE 10

| | Sliding Performance of the Back Layer | | |
|---|---|---|---|
| Film | Coefficient of Sliding Friction | Frictional Force (against camera pressure plate) (g) | Transparency |
| 6-1 (Control) | 0.36 | 200–300 | Good |
| 6-2 (Invention) | 0.18 | 60–70 | Good |
| 6-3 (Comparison) | 0.23 | 100–110 | Poor |

EXAMPLE 6

Three celulose triacetate bases were coated with Coating Composition 6-1 of Example 5 and dried at 90° C. for three minutes to obtain antihalation layers which were then coated with coating compositions having the following compositions and dried at 90° C. for three minutes.

TABLE 11

| | Coating Composition (parts) | | |
|---|---|---|---|
| | 7-1 | 7-2 | 7-3 |
| Butanol | 1,000 | 1,000 | 1,000 |
| Methyl Cellosolve | 100 | 100 | 100 |
| Hydroxypropyl methyl cellulose hexahydrophthalate (of the same composition as that of Example 5) | 5 | 5 | 5 |
| Microfine polyacrylonitrile (particle size: 1–5 μ) | 0.5 | 0.5 | 0.5 |
| Compound (1) | — | 1 | — |
| Comparison Compound (A) | — | — | 0.25 |
| Obtained Base | Base 7-1 | Base 7-2 | Base 7-3 |

These above three bases (7-1, 7-2 and 7-3) were coated with the same emulsion for color negative films as in Example 1 to obtain Films 7-1, 7-2 and 7-3, respectively.

The films were tested for sliding performance as in Example 1 and the results shown below were obtained.

TABLE 12

| | Sliding Performance of the Back Layer | |
|---|---|---|
| Film | Coefficient of Sliding Friction | Frictional Force (against camera pressure plate) (g) |
| 7-1 | 0.34 | 120–140 |
| 7-2 | 0.21 | 50–60 |
| 7-3 | 0.20 | 100–110 |

From Table 12, it is evident that Film 7-2 of the present invention exhibits remarkably excellent in-camera running properties in actual use.

EXAMPLE 7

Triacetyl cellulose photographic film supports were coated with undercoats after which each was coated with a red-sensitive emulsion layer, a gelatin intermediate layer, a green-sensitive emulsion layer, a yellow filter layer and a blue-sensitive emulsion layer successively. As the top layer, two surface protective layers having the compositions shown in Table 13 were applied to prepare Samples 7A and 7B, respectively.

TABLE 13

| | Coating Composition for the Surface Protective Layer | |
|---|---|---|
| | 7A | 7B |
| 5% Gelatin aqueous solution | 1,000 ml | 1,000 ml |
| 5% Sodium dodecylbenzenesulfonate aqueous solution | 20 ml | 20 ml |
| 2% Bis-vinylsulfonylmethyl ether aqueous solution | 20 ml | 20 ml |
| Polymethyl methacrylate (average particle size: 2μ) | 2 g | 2 g |
| Emulsified dispersion of Compound (4)* | 60 ml | — |
| Emulsified dispersion of liquid paraffin (Comparison)* | — | 60 ml |

*Preparation of emulsified dispersions of Compound (4) and liquid paraffin:

10 ml of a 5% sodium dodecylbenzenesulfonate aqueous solution were added to 100 ml of a 10% gelatin aqueous solution, to which 5 g of either Compound (4) of the present invention or liquid paraffin which had been preheated to 90° C. and melted were gradually added with vigorous stirring while keeping the temperature at 45° C. The mixture was stirred vigorously in a homogenizer for additional 10 minutes to complete dispersing. The obtained dispersions contained particles having an average particle size of 0.8μ to 1.0μ and were very stable at room temperature.

Samples 7A and 7B were processed into test strips of 8 mm in width and tested for adhesion to the gate section of a camera according to the following test method. The results were 18 operations for Sample 7A and 2 operations for 7B.

Test Method

Samples 7A and 7B cut into 8 mm widths and allowed to stand for two hours in a room kept at 35° C. and 90% RH, after which the films were loaded into 8 cameras and it was confirmed that they were workable by pressing the shutters. Then, after being allowed to stand under the same conditions for 5 minutes, the cameras were operated again. If the surface of the emulsion layer stuck strongly to the gate section during this five minute period, the camera was considered not to work this time. The above operation was repeated by rotating the cameras and thus each sample was tested three times on each camera for a total of 24 times. The number of times were the cameras operated were counted.

In addition, according to a method described in J. SMPTE, Vol. 80, pp. 734–739 (1971), an angle of slip of a paper clip to the surface of an emulsion layer of a film was determined and the results were 11.5° for Sample 7A and 20.0° for Sample 7B. (The angle of slip is the angle at which the sample slips off as measured under the conditions of 25° C. and 60% RH after conditioning for 4 hours under the same conditions.)

As evident from the above results, it can be seen that the samples containing the compunds in accordance with the present invention significantly improve slip properties an ameliorate the troubles due to the adhesion of the surface of an emulsion layer of a film to the gate section of an 8 mm cinecamera as compared with the known conventional film samples containing liquid paraffin.

While the invention has been described in detail and with reference to specific embodiments thereof, it will be apparent to one skilled in the art that various changes and modifications can be made therein without departing from the spirit and scope thereof.

What is claimed is:

1. In a photographic photosensitive material, the improvement which comprises at least one surface layer of the photographic photosensitive material containing an organic carboxylic acid amide of the formula (I):

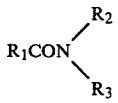

(I)

wherein $R_1$ represents a hydrocarbon group having 18 to 23 carbon atoms and at least one double bond and each of $R_2$ and $R_3$ represents a hydrogen atom or a lower alkyl group having 1 to 4 carbon atoms.

2. The photographic material of claim 1, wherein said surface layer is a protective layer and/or a back layer.

3. The photographic material of claim 1, wherein said material comprises a back layer containing the compound of the formula (I):

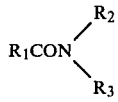

(I)

wherein $R_1$ represents a hydrocarbon group having 18 to 23 carbon atoms and at least one double bond and each of $R_2$ and $R_3$ represents a hydrogen atom or a lower alkyl group having 1 to 4 carbon atoms.

4. The photographic material of claim 1, wherein said surface layer is a layer overcoating a protective layer and/or a back layer.

5. The photographic material of claim 1, wherein said surface layer contains a hydrophilic colloid as a binder.

6. The photographic material of claim 5, wherein said compound is present in said hydrophilic colloid layer in an amount of about 0.02 to 10% by weight based on the solid content of the coating composition from which the layer is prepared.

7. The photographic material of claim 3, wherein said back layer comprises a hydrophobic binder.

8. The photographic material of claim 7, wherein said compound is present in said layer in an amount of about 5 to 500 mg/m$^2$.

9. The photographic material of claim 4, wherein said compound is present in said overcoated layer in an amount of about 5 to 500 mg/m$^2$.

10. The photographic material of claim 1, wherein $R_1$ contains 21 to 23 carbon atoms.

11. The photographic material of claim 1, wherein $R_1$ contains 21 to 23 carbon atoms and $R_2$ or $R_3$ is a hydrogen atom, a methyl group or an ethyl group.

12. The photographic material of claim 1, wherein said amide is selected from the group consisting of erucic amide, erucic acid-N-methylamide, erucic acid-N-ethylamide, selacholeic acid-N-methylamide and selacholeic acid-N,N-diethylamide.

13. The photographic material of claim 1, wherein $R_1$ contains one carbon-to-carbon double bond.

* * * * *